US006408553B1

(12) United States Patent
Brown et al.

(10) Patent No.: US 6,408,553 B1
(45) **Date of Patent: *Jun. 25, 2002**

(54) ADHESIVE SHELF TALKER

(75) Inventors: Kevin J. Brown, Danville, CA (US); Timothy W. Rawlings, Waynesville; Michael E. Hetrick, Dayton, both of OH (US)

(73) Assignee: NCR Corporation, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/318,021

(22) Filed: May 25, 1999

(51) Int. Cl.[7] ..... G09F 3/18

(52) U.S. Cl. ..... 40/661.03; 40/594; 40/638; 40/651; 40/661.09; 248/223.41; 248/222.12

(58) Field of Search ..... 40/594, 638, 651, 40/661.03, 661.09; 248/223.41, 222.12; 211/57.1

(56) References Cited

U.S. PATENT DOCUMENTS

| | | | | |
|---|---|---|---|---|
| 1,689,444 A | | 10/1928 | Manshel | |
| 2,755,576 A | * | 7/1956 | Golden | 40/594 X |
| 3,290,809 A | * | 12/1966 | King | 40/661.03 X |
| 3,753,305 A | * | 8/1973 | Mueh | 40/661.03 X |
| 4,179,138 A | * | 12/1979 | Bogdanovic | 40/651 X |
| 4,338,739 A | * | 7/1982 | Greenberger | 40/661.03 X |
| 4,477,048 A | * | 10/1984 | Conway | 40/661.03 X |
| 4,483,502 A | * | 11/1984 | Fast | 40/661.03 X |
| 4,572,380 A | * | 2/1986 | Langwell | 211/57.1 |
| 4,693,441 A | * | 9/1987 | Conway | 248/220.41 |
| 4,718,627 A | * | 1/1988 | Fast et al. | 248/222.12 |
| 5,042,768 A | * | 8/1991 | Goldstein | 248/223.41 |
| 5,182,152 A | | 1/1993 | Ericson | |
| 5,284,689 A | * | 2/1994 | Laurash et al. | 428/40 |
| 5,332,265 A | | 7/1994 | Groess et al. | |
| 5,585,156 A | | 12/1996 | Fontana | |
| 5,970,640 A | * | 10/1999 | Farrow | 40/638 |
| 6,186,555 B1 | * | 2/2001 | Rawlings | 283/81 |

OTHER PUBLICATIONS

FLEXcon, "A Retail Applications Guide", pp 1–10, Jul. 15, 1997.

* cited by examiner

*Primary Examiner*—Jack Lavinder
*Assistant Examiner*—Andrea Chop
(74) *Attorney, Agent, or Firm*—Francis L. Conte

(57) ABSTRACT

A shelf talker includes a label having a top strip for mounting to a shelf bracket, and a bottom leaflet for printing product information. A release liner is adhesively bonded to the label across the strip only, with the leaflet being linerless.

10 Claims, 4 Drawing Sheets

ADHESIVE SHELF TALKER

BACKGROUND OF THE INVENTION

The present invention relates generally to product labels, and, more specifically, to shelf talkers.

Merchandising stores typically display on shelves different products with different prices. In a typical food market, for example, the shelves include a C-shaped metal bracket extending along the front edge thereof in which individual shelf product labels may be affixed for the corresponding products displayed.

A typical shelf label is in the form of a small pressure sensitive label, with the adhesive thereon typically providing permanent retention of the label within the shelf bracket itself. Alternatively, the shelf label may be bonded to a plastic insert or clip which itself is trapped in the shelf bracket at the designated location.

A shelf talker is a special type of product label typically used for promoting brand identity, units of measure, price comparisons, and special sale pricing and promotions. The shelf talker is typically larger than the permanent shelf label and is in addition thereto for increasing the visibility of products being promoted.

Shelf talkers are typically provided in groups of similar size on individual sheets for collectively printing the desired information thereon. Fixed information, such as store identification and product graphics, is typically pre-printed in large quantities of the sheets in any suitable manner during the production of the shelf talkers. Variable information, such as the specific product, size, and promotional price, may then be locally printed on each of the shelf talkers in a common sheet using a suitable printer such as thermal transfer, laser, and direct thermal printing.

Due to their temporary nature, shelf talkers must be easy to produce, install, and remove, as well as being durable enough to withstand their intended use. And, cost is a significant factor which affects shelf talker usage.

Shelf talkers have enjoyed years of successful use in this country in promoting shelf products. A typical shelf talker is formed entirely of card stock which is relatively inexpensive, is easily printed, and is sufficiently stiff for preventing undesirable curling when temporarily mounted to the shelf bracket. Mounting is typically accomplished by providing a central die-cut tab near the top of the card which permits the bottom of the tab and the top of the card to be trapped in corresponding top and bottom hooks of the shelf bracket. In this way, the card talker is mechanically retained in the shelf bracket, which is sufficient for its limited duration use.

However, the card talkers are therefore subject to being inadvertently removed from the shelf or slid therealong when hit by a customer.

This problem may be solved by using full label sheet shelf talkers which have also enjoyed years of successful commercial use in this country. This type of shelf talker includes a label sheet adhesively bonded to a release liner so that the top portion of the liner may be removed for adhesively bonding the top of the label to the shelf bracket. The typical adhesive provides a temporary bond with the bracket so that the label may be removed when desired. The adhesive also prevents inadvertent removal or sliding of the label on the bracket.

However, label-sheet shelf talkers are significantly more expensive than card-stock shelf talkers and are less resistant to curl. The typical label talker uses fifty pound face stock for the label and fifty pound release liner which have substantially less stiffness than the typical eight point card stock shelf talkers. And, due to the specialized face sheet material used in label talkers, special coatings may be required thereon for permitting satisfactory on-demand printing of the labels in the field.

Accordingly, it is desired to provide an improved shelf talker which is economical, stiff, printable, and temporarily bondable to a shelf bracket without movement.

BRIEF SUMMARY OF THE INVENTION

A shelf talker includes a label having a top strip for mounting to a shelf bracket, and a bottom leaflet for printing product information. A release liner is adhesively bonded to the label across the strip only, with the leaflet being linerless.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
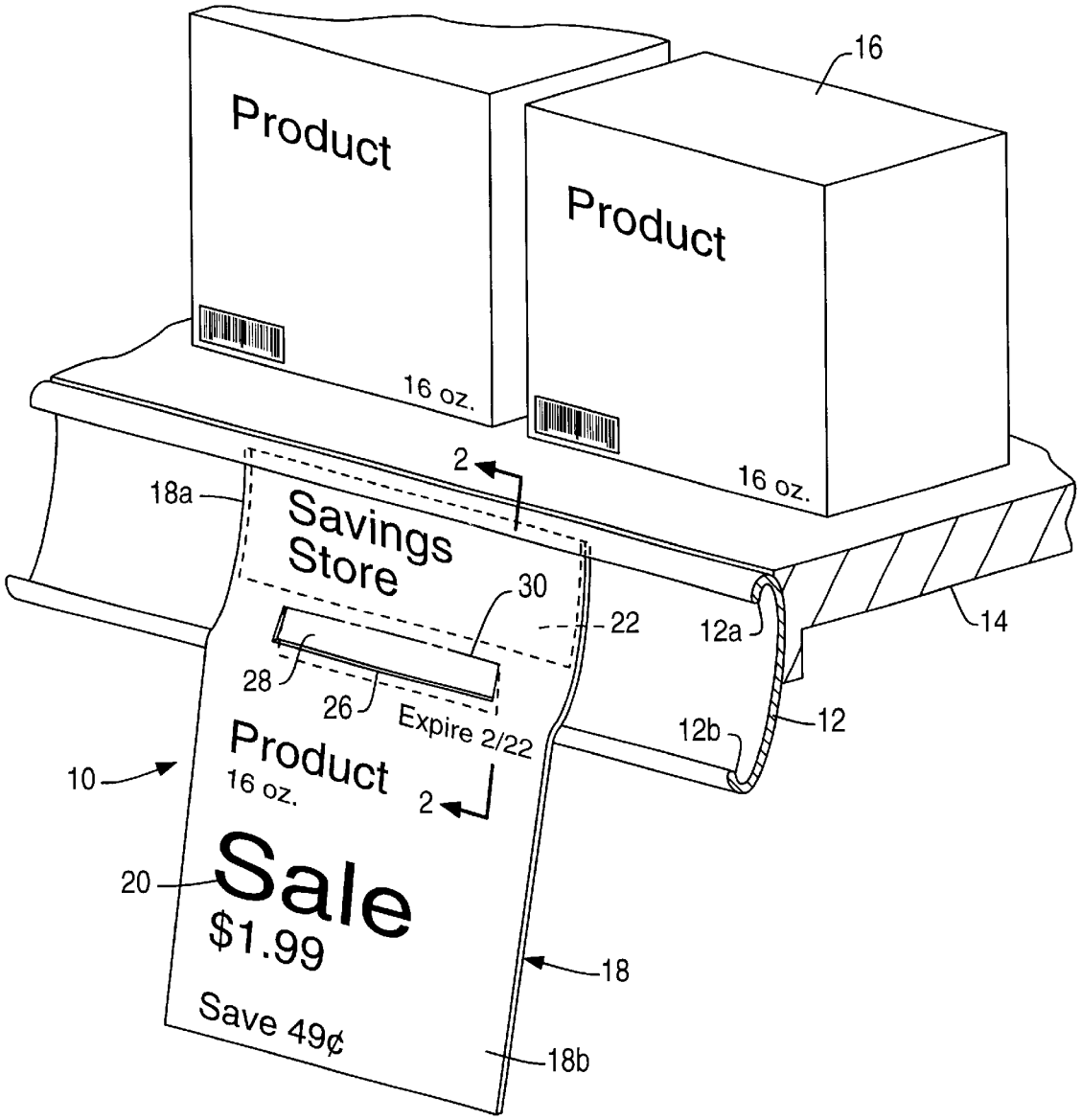
FIG. 1 is an isometric view of a portion of an exemplary shelf containing products thereon, with a shelf bracket supporting a shelf talker in accordance with an exemplary embodiment of the present invention.

Illustrated in FIG. 1 is an exemplary display tag or shelf talker 10 removably mounted to a shelf bracket 12 disposed along the front edge of a display shelf 14 in accordance with an exemplary embodiment of the present invention. The shelf talker 10 is typically provided to identify a special promotion of a corresponding product 16 displayed in batches atop the shelf 14, such as in a typical grocery store or supermarket.

The bracket 12 and shelf 14 may take any conventional form such as those illustrated. The typical bracket 12 is a metal extrusion which is C-shaped in cross section, with top and bottom J-hooks 12*a,b*. The bracket is sized for receiving standard product shelf labels (not shown) which permanently designate the location of the shelf space reserved for a given product. A typical shelf label is a narrow pressure sensitive label configured for being adhesively bonded within the height of the shelf bracket, with a suitable length therein. The shelf label typically identifies the product, and may also include its regular price.

In a typical sale promotion of an individual product, it is desirable to use a corresponding shelf talker 10 which is typically larger in size than the shelf label and is temporarily mounted to the bracket for promoting the product.

As shown in FIG. 1, the shelf talker 10 may have any suitable size and configuration, and is typically rectangular.

The shelf talker includes a label 18 having a front side for promoting the product and an opposite back side for attachment to the bracket. The label includes a rectangular top strip 18*a* which extends horizontally across the full width of the label and is integrally joined to a rectangular bottom leaflet 18*b* in a preferably unitary, one-sheet configuration.

The top strip 18*a* is sized and configured for being mounted to the bracket 12. And, the leaflet 18*b* is sized and configured for printing atop the front thereof any desirable product information 20 describing or promoting the specific products. In the exemplary embodiment illustrated in FIG. 1, the label identifies the name of the particular store, the particular product, and a promotional sale price therefor for promoting a temporary price reduction. Other descriptions or promotions as desired may be printed atop the label 18.

Figure 2:
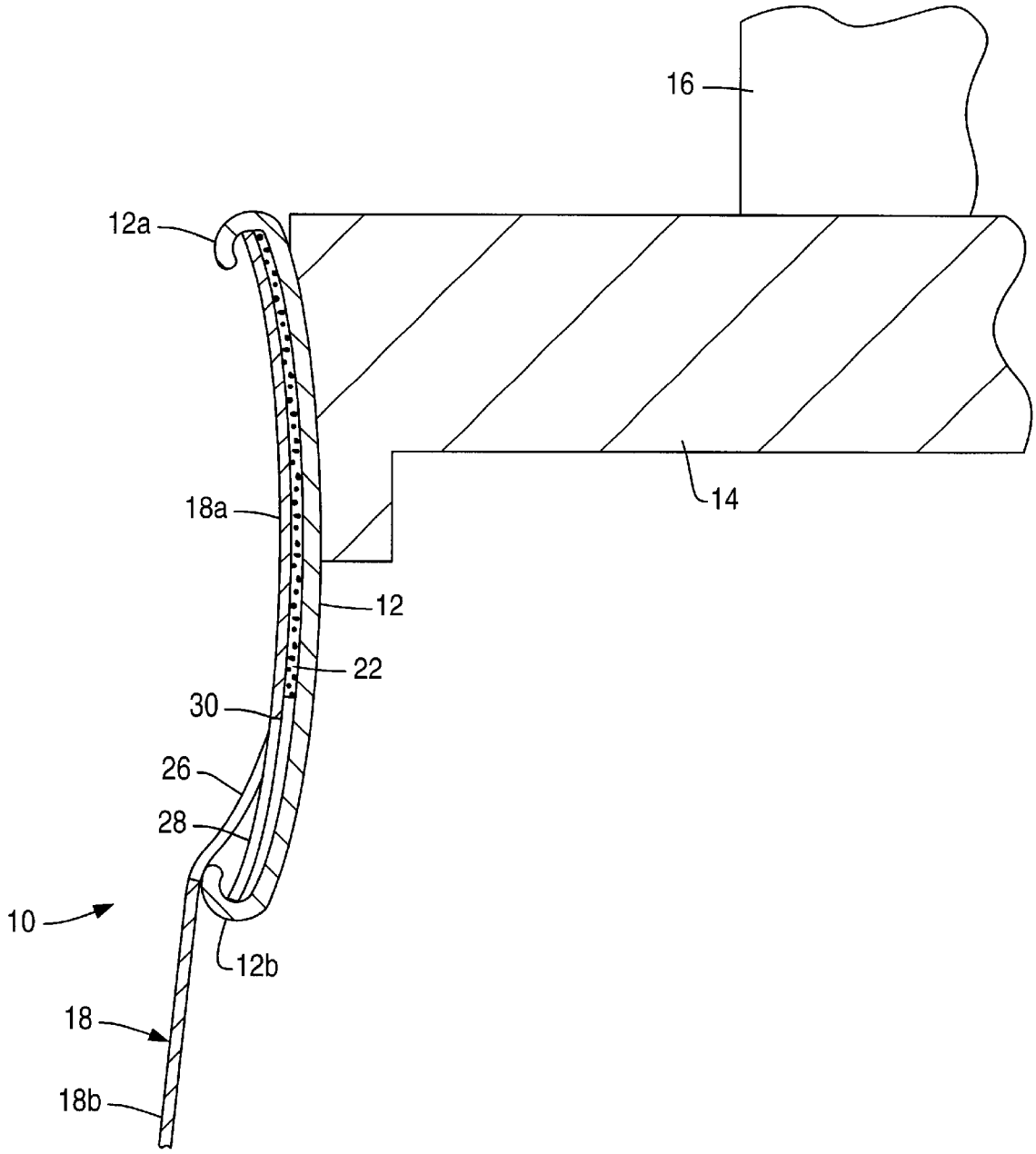
FIG. 2 is an elevational, cross sectional view of the shelf talker and bracket illustrated in FIG. 1 and taken along line 2—2.

In accordance with one feature of the present invention, the back of the top strip 18*a* includes a suitable adhesive 22 coated thereon for permitting the strip to be releasably bonded to the bracket 12 in the manner of a typical pressure sensitive label. FIG. 2 illustrates in cross section the strip 18*a* bonded to the bracket by the adhesive 22 for temporarily mounting the shelf talker 10 to the bracket, with the leaflet 18*b* typically being suspended downwardly.

Figure 3:
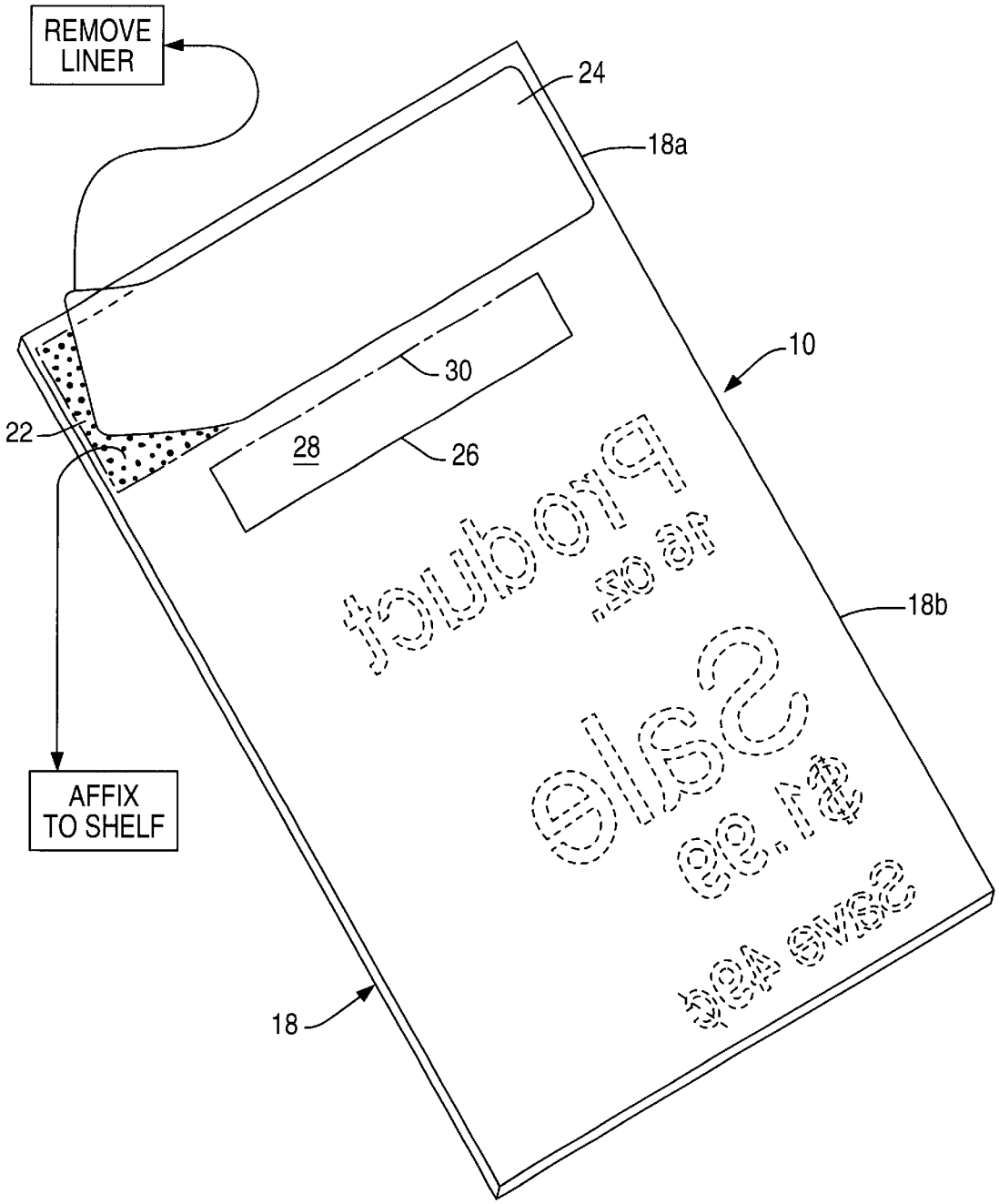
FIG. 3 is an isometric view of the back of the shelf talker illustrated in FIG. 1, with a flowchart representation of an exemplary method of using the shelf talker in the shelf bracket.

FIG. 3 illustrates the shelf talker 10 of FIGS. 1 and 2 prior to assembly to the bracket and initially including a release liner 24 which is adhesively bonded to the label across the top strip 18*a* by the adhesive 22. The adhesive 22 is provided only across the back of the top strip 18*a* for permitting the strip to be temporarily bonded to the shelf bracket 12 to prevent its inadvertent removal or displacement therein. The leaflet 18*b* is both adhesiveless and linerless, without any adhesive thereon for reducing complexity of the shelf talker and reducing cost thereof, while permitting improved performance thereof.

More specifically, the label portion of the shelf talker illustrated in FIGS. 1–3 is preferably formed of conventional card stock for maintaining stiffness thereof and resistance to curling. Typical card stock has a weight or stiffness conventionally designated eight point (8 pt.). In this way, the card stock label 18 may enjoy all of the advantages of a conventional card stock shelf talker, but with the addition of the selectively applied adhesive 22 and corresponding release liner 24 therefor.

A typical pressure sensitive label laminate used for shelf talkers has fifty pound label sheet and fifty pound release liner which collectively are more flexible than the eight point card stock. And, as indicated above, full label sheets are substantially more expensive than card stock shelf talkers, although commonly in use for their ability to maintain fixed to the shelf bracket.

The shelf talker 10 may be simply used by printing the product information 20 shown in FIG. 1 in any suitable manner atop the front of the label 18. The liner 24 illustrated in FIG. 3 may then be readily removed from the back of the label strip 18*a* by simply being peeled away therefrom. And, the label strip 18*a* may then be affixed to the shelf bracket illustrated in FIGS. 1 and 2 using the same adhesive 22 provided on the back of the strip, with the label then being supported by the bracket with its leaflet 18*b* being suspended downwardly for full view by passing customers.

Although the label 18 may be adhesively bonded by its top strip to the shelf bracket, the label is preferably also mechanically retained in the bracket as shown in FIGS. 1–3. More specifically, the label preferably includes a die cut 26 extending along three edges of a rectangle centrally between the top strip 18*a* and the leaflet 18*b* in a generally U-shape. The die cut 26 defines an integral rectangular tab 28 which extends horizontally and faces downwardly from the strip to the leaflet, and is bendable about an integral top hinge 30 which extends along the fourth edge of the rectangle defining the tab. The tab is used for mechanically mounting the label to the bracket in the preferred embodiment.

More specifically, a method of mounting the label to the shelf bracket 12 as shown in FIGS. I and 2 initially includes bending the tab 28 along the hinge 30 to separate the three cut edges of the tab from the leaflet 18*b*. The liner 24 is removed from the back of the strip 18*a* to expose the adhesive 22 hidden therebelow. The strip 18*a* and the tab 28, as best illustrated in FIG. 2, are inserted into the bracket 12 for supporting the leaflet 18*b* therefrom both mechanically and adhesively.

As shown in FIG. 2, the label 18*a* has a top leading edge which is trapped in the top hook 12*a* of the bracket. And, the tab 28 has a bottom trailing edge which is correspondingly trapped in the bottom hook 12*b* of the bracket. Since the label strip is formed of card stock, it is relatively rigid and permits the strip and tab to tightly fit inside the bracket 12 in a mechanically tight fit therein corresponding to that of a conventional card shelf talker.

However, the adhesive provided on the back of the label strip 18*a* is used for bonding the strip to the inside surface of the bracket 12 for maintaining a fixed position of the shelf talker along the length of the bracket. The strip and tab are therefore directly mounted in the bracket and adhesively bonded thereto until the need for the removal thereof. Removal is simply accomplished by pulling the label away from bracket which breaks the temporary adhesive bond therewith. The shelf talker may therefore be directly mounted to the bracket 12 without the need for any intervening supporting clip, which are commonly found in the industry.

Figure 4:
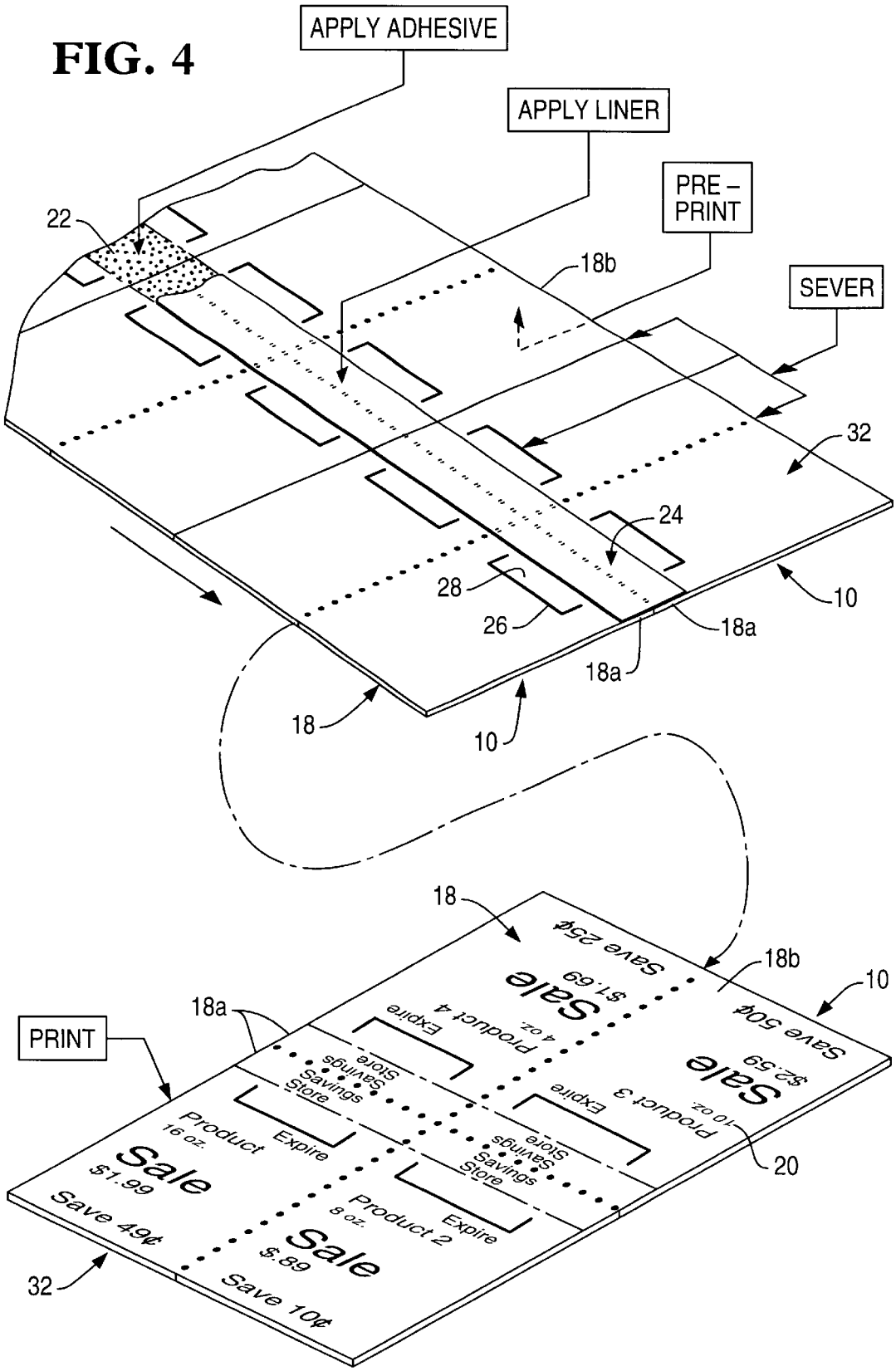
FIG. 4 is an isometric view of shelf talkers manufactured in groups in a series of common sheets, with a flowchart representation of an exemplary method of manufacturing the shelf talkers.

FIG. 4 illustrates schematically an exemplary method of manufacturing the shelf talkers 10 illustrated in FIGS. 1–3 arranged in a group or set thereof in a common sheet 32. In the exemplary embodiment illustrated, there are four shelf talkers arranged on an individual rectangular sheet 32 of standard size such as eight and a half by eleven inches. And, a series of the sheets 32 are initially formed side by side in a continuous sheet unwound from a roll. The liners 24 preferably bridge each sheet 32 from edge-to-edge along the narrower width thereof as opposed to its longer length.

In a preferred embodiment, the individual labels are disposed strip-to-strip or head-to-head in the sheet, with the respective liners 24 thereof adjoining each other. The liners 24 preferably defines a common ribbon along the width of the sheet and along the running axis of the adjoining sheets for permitting liner application in a single strip along the center of the sheets. This may be accomplished in a conventional manner in which the sheet defining the labels is laminated with the liner ribbon by extruding the adhesive 22 therebetween in a continuous process as the sheets and liners are laminated along the running axis thereof.

The individual labels 18 and corresponding liners 24 may then be suitably severed at least in part to permit separation of individual ones of the shelf talkers from their neighbors in the common sheets. Severing may be accomplished in any conventional manner such as providing lines of perforations along the centers of the length and width of the common sheets 32, along which the individual shelf talkers may be separated by tearing. The individual tabs 28 may be provided by the corresponding die cuts 26 therefor.

Any desired product description or information 20 may be printed atop the strip 18*a* and leaflet 18*b* in any convenient manner. For example, fixed information may be preprinted atop the label during formation of the label sheets in a continuous process. The individual sheets 32 are then separated from each other and grouped in packages for use locally at particular retail stores. Local printing may then be used for the desired variable information on each of the individual shelf talkers as desired. And, as indicated above, the individual shelf talkers may be separated from the sheet, the corresponding release liner 24 removed therefrom, and the tab deployed for mechanically and adhesively mounting the shelf talker in its intended position along the shelf bracket.

The resulting card-stock shelf talker is relatively inexpensive, has enhanced stiffness for resisting undesirable curl, and is readily printable and applied to the shelf brackets with ease. The individual shelf talkers may be readily removed from the bracket by simply being pulled away therefrom which overcomes the bond of the adhesive and the mechanical retention by the strip and tab.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A shelf talker sheet for use in a printer to print product information thereon for display on a shelf bracket, comprising:

a plurality of shelf talkers arranged in a group in a common sheet for being passed through said printer to print said product information thereon;

each of said shelf talkers including a card stock label for maintaining stiffness thereof, with a top strip having adhesive on a back thereof for being adhesively mounted to said shelf bracket, and a bottom leaflet for receiving said product information printed thereon in said printer and being fully exposed for displaying said product information on said shelf bracket;

a release liner bonded to said adhesive across only said top strips, with said leaflets being linerless; and each of said card stock labels including a die cut between said strip and leaflet extending along three edges of a rectangle to define a tab bendable about a hinge along a fourth edge of said rectangle for mounting said label to said bracket.

2. A method of using said shelf talker sheet according to claim 1 comprising:

printing said product information atop said label leaflets;

separating one of said shelf talkers from said sheet; removing said liner from said strip of said one separated shelf talker;

bending said tab of said one separated shelf talker along said hinge to separate said tab from said leaflet; and inserting said strip and tab of said one separated shelf talker in said bracket and affixing said strip by said adhesive to said bracket to support said label leaflet therefrom.

3. A method according to claim 2 wherein said bracket is C-shaped in section with top and bottom hooks, and said strip of said one separated shelf talker has a leading edge and said tab thereof has a trailing edge trapped in corresponding ones of said bracket hooks.

4. A method according to claim 3 wherein said strip and tab are directly mounted in said bracket.

5. A shelf talker sheet according to claim 1 wherein said labels are aligned strip-to-strip in said sheet, and said liner extends along said strips.

6. A shelf talker sheet according to claim 5 wherein said liner defines a common ribbon along said sheet, with said labels and liner being severed at least in part to permit separation of individual ones of said shelf talkers from said sheet.

7. A shelf talker sheet according to claim 1 wherein said leaflets include said product information printed thereon.

8. A shelf talker sheet according to claim 7 wherein said strips include printing thereon.

9. A shelf talker for use in a printer to print product information thereon for display on a shelf bracket, comprising:

a card stock label for maintaining stiffness thereof, with a top strip having adhesive on a back thereof for being adhesively mounted to said shelf bracket, and a bottom leaflet for receiving said product information printed thereon in said printer and being fully exposed for displaying said product information on said shelf bracket;

a release liner bonded to said adhesive across only said top strip, with said leaflet being linerless; and a die cut between said strip and leaflet extending along three edges of a rectangle to define a tab bendable about a hinge along a fourth edge of said rectangle for mounting said label to said bracket.

10. A shelf talker for use in a printer to print product information thereon for display on a shelf bracket, comprising:

a card stock label for maintaining stiffness thereof, with a top strip having exposed adhesive on a back thereof for being adhesively mounted to said shelf bracket, and an adhesiveless bottom leaflet for receiving said product information printed thereon in said printer and being fully exposed for displaying said product information on said shelf bracket; and a die cut between said strip and leaflet extending along three edges of a rectangle to define a tab bendable about a hinge along a fourth edge of said rectangle for mounting said label to said bracket.

* * * * *